United States Patent [19]

Wudel et al.

[11] 4,180,887

[45] Jan. 1, 1980

[54] VACUUM-CLEANER ATTACHMENT

[75] Inventors: Egon Wudel, Velbert; Georg Haase, Radevormwald, both of Fed. Rep. of Germany

[73] Assignee: Vorwerk & Co. Interholding GmbH, Wuppertal

[21] Appl. No.: 869,855

[22] Filed: Jan. 16, 1978

[30] Foreign Application Priority Data

Jan. 15, 1977 [DE] Fed. Rep. of Germany ... 7701111[U]

[51] Int. Cl.[2] ..... A47L 9/06

[52] U.S. Cl. ..... 15/415 R; 15/359

[58] Field of Search ..... 15/415 R, 359, 360, 15/371, 372

[56] References Cited

U.S. PATENT DOCUMENTS

| | | | |
|---|---|---|---|
| 2,856,628 | 10/1958 | Vance | 15/359 |
| 2,874,400 | 2/1959 | Burrage | 15/359 |
| 2,881,465 | 4/1959 | Duff | 15/360 |
| 3,676,892 | 7/1972 | Nordeen | 15/359 |
| 3,739,421 | 6/1973 | Fukuba | 15/415 X |
| 3,772,727 | 11/1973 | Worwag | 15/372 X |

FOREIGN PATENT DOCUMENTS

| | | | |
|---|---|---|---|
| 2364750 | 7/1975 | Fed. Rep. of Germany | 15/371 |

*Primary Examiner*—Philip R. Coe

*Attorney, Agent, or Firm*—Michael J. Striker

[57] ABSTRACT

A vacuum-cleaner attachment includes a mouthpiece and a suction nipple which communicates with a suction space bounded by the mouthpiece. Two stub shafts mount the mouthpiece on the suction nipple for relative pivoting, and an elastic element is interposed between the suction nipple and the mouthpiece and urges the latter toward a predetermined position thereof relative to the suction nipple. The elastic element may be a spring which is convoluted about an extension of one of the stub shafts and having two end portions, one of which is received in a slot-shaped depression of the stub shaft and the other of which abuts against the mouthpiece.

4 Claims, 6 Drawing Figures

VACUUM-CLEANER ATTACHMENT

BACKGROUND OF THE INVENTION

The present invention relates to vacuum-cleaner attachments in general, and more particularly to a vacuum-cleaner attachment which includes a mouthpiece and a suction nipple which are movable relative to one another.

There has already been proposed a vacuum-cleaner attachment of the above-mentioned type in which the suction nipple is movable relative to the mouthpiece along a plane which extends normal to the surface being vacuum-cleaned during the use of the attachment. More particularly, the mouthpiece and the suction nipple are connected to one another for relative pivoting along the above-mentioned plane as a result of which the mouthpiece is capable of following the contour being vacuum-cleaned and the user of the attachment can select a convenient angle at which the axis of the suction nipple extends with respect to the surface being cleaned. Thus, the movable connection of the mouthpiece to the suction nipple is very convenient and advantageous.

However, experience with this conventional arrangement has shown that, particularly where the vacuum cleaner itself is supported on the suction nipple and thus on the mouthpiece, the prior-art construction is disadvantageous in some respects. First of all, it is quite common that the vacuum-cleaner equipped with such a bipartite and movable attachment is leaned against a wall or a similar substantially vertical support during the periods of non-use of the vacuum-cleaner. As a result of the movable mounting of the mouthpiece on the suction nipple, the bottom surface of the mouthpiece remains in contact with the floor or with the floor cover, such as a carpet or the like, while the suction nipple moves through an angle sufficient for the vacuum-cleaner to abut against the wall or the like. Under these circumstances, the weight of the vacuum-cleaner subjects the mouthpiece the two forces, one of which is normal to the plane of the floor surface and the other of which is parallel thereto. On the other hand, the vacuum-cleaner abuts the wall against which it leans with a reaction force which is equal but opposite to the above-mentioned other force. It will be appreciated that the magnitude of the other and reaction forces will be proportionate to the angle which the elongation of the vacuum-cleaner encloses with the vertical. When the other force exceeds the frictional force which holds the mouthpiece in the then assumed position, either as a result of an excessive leaning angle of the vacuum-cleaner, or because of a low friction coefficient between the bottom surface of the mouthpiece and the floor surface or the floor cover, the mouthpiece will start sliding on the floor surface or on the surface cover as a result of which the vacuum-cleaner descends along the exposed surface of the wall or the like. This is disadvantageous in two respects in that, first of all, the vacuum-cleaner may damage the exposed surface of the wall during its descent and, secondly, the vacuum-cleaner may become damaged as a result of its impact against the floor. The danger of this happening is especially pronounced when the bottom surface of the mouthpiece is metallic, as is often the case.

On the other hand, the surface being vacuum-cleaned is not always exactly level. So, for instance, it may happen that the mouthpiece is to be moved over an edge of a carpet or the like. Under these circumstances, it may happen that the mouthpiece will move relative to the suction nipple into a position in which the bottom surface of the mouthpiece is no longer juxtaposed with the surface to be vacuum-cleaned. Then, the user of the vacuum-cleaner equipped with such a bipartite movable attachment must interrupt the vacuum-cleaning operation and pivot the mouthpiece into the proper position before resuming such an operation.

SUMMARY OF THE INVENTION

Accordingly, it is a general object of the present invention to avoid the disadvantages of the prior art.

More particularly, it is an object of the present invention to so construct a bipartite movable attachment as to avoid the disadvantages of the conventional attachments of this type.

It is still another object of the present invention to develop an attachment of the above-mentioned type in which the vacuum-cleaner equipped with such an attachment is securely retained in its leaning position.

A yet another object of the present invention is to so construct the attachment so as to avoid the need for manually readjusting the position of the mouthpiece relative to the suction nipple subsequent to the passage of the attachment over an obstruction.

A concomitant object of the present invention is to provide an attachment which is simple in construction, inexpensive to manufacture, easy to handle, and reliable nevertheless.

In pursuance of these objects and others which will become apparent hereafter, one feature of the present invention resides, briefly stated, in a vacuum-cleaner attachment which comprises, in combination, a mouthpiece member bounding a suction space; a suction nipple member; means for so mounting the members on one another that the suction nipple member communicates with the suction space and is movable relative to the mouthpiece member along a plane which is substantially normal to the surface being vacuum-cleaned during the use of the attachment; and biasing means which is interposed between the members and urges the same toward a predetermined position thereof relative to one another. Advantageously, the mounting means includes at least one pivot which connects the members for relative pivoting along the plane.

In a currently preferred embodiment of the present invention, the pivot is a stub shaft rigid with the suction nipple member and extending therefrom normal to and away from the above-mentioned plane. Then, the mounting means advantageously further includes an additional stub shaft similar to and aligned with said stub shaft and located across the plane from the latter. Advantageously, the above-mentioned pivot has an extension and the biasing means includes an elastic element which is affixed to the extension and has an engaging portion which acts on the mouthpiece member and urges the same toward the above-mentioned predetermined position. In this context, it is especially advantageous when the elastic element is a spring which is convoluted about the extension of the pivot and which has two end portions one of which is affixed to the extension and the other of which constitutes the engaging portion and abuts the mouthpiece member. Preferably, the extension has a channel which receives the one end portion of the spring to affix the same to the pivot, the channel being preferably configurated as a slot-shaped depression that extends across the extension and opens onto an end face thereof.

When the attachment is constructed in the above-mentioned manner, it brings about the advantage that, when the mouthpiece is lifted from the surface being vacuum-cleaned the mouthpiece will automatically assume the above-mentioned predetermined position relative to the suction nipple so that there is no longer the need to readjust the position of the mouthpiece subsequent to encountering an obstruction. Rather, it is sufficient to appropriately lower the attachment toward the surface to be vacuum-cleaned in view of the fact that, in the above-mentioned predetermined position and in the position of the suction nipple assumed during the normal use of the attachment, the bottom surface of the mouthpiece will extend parallel to the surface to be vacuum-cleaned. On the other hand, when the suction nipple is pivoted relative to the mouthpiece into the above-discussed leaning position of the vacuum-cleaner, the elastic element or spring will still urge the mouthpiece toward its predetermined position relative to the suction nipple as a result of which the mouthpiece will contact the floor surface or the floor cover at its front edge as considered in the direction of movement of the mouthpiece away from the user during the normal use of the vacuum-cleaner, rather than at the entire bottom surface of the mouthpiece. Thus, the danger of sliding of the leaning vacuum-cleaning is considerably reduced if not entirely eliminated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DISCUSSION OF THE PREFERRED EMBODIMENTS

Figure 1:
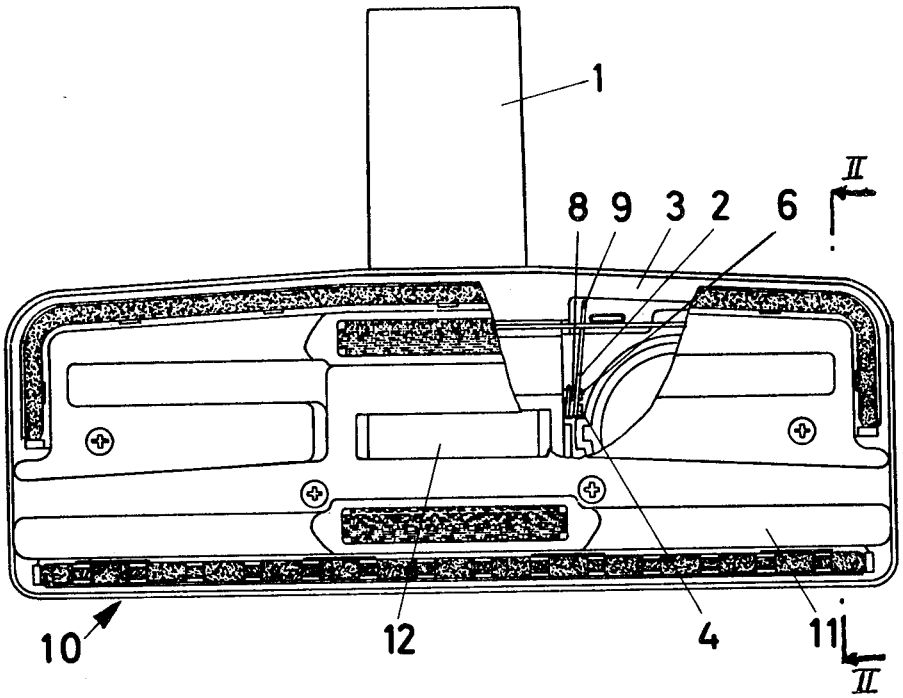
FIG. 1 is a partially sectioned bottom plan view of the attachment of the present invention.

Referring now to the drawings in detail, and first to FIG. 1 thereof, it may be seen that the reference numeral 10 has been used to designate a mouthpiece 10 which has a bottom wall 11. The bottom wall 11 has been partially broken-away in order to expose the interior of the mouthpiece 10 to view.

The mouthpiece 10 has a suction port 12. A suction nipple 1 communicates with the suction port 12 and with a non-illustrated vacuum-cleaner so that, during the use of the attachment, air is withdrawn from a suction space bounded by the mouthpiece 10 through the suction port 12 and the interior of the suction nipple 1 toward the vacuum-cleaner proper.

A pivot 4, which is rigid with the suction nipple 1, mounts the latter on the mouthpiece 10 for pivoting relative thereto upwardly of and in communication with the suction port 12. Preferably, the pivot 4 includes two stub shafts, one at each side of the suction nipple 1, only one of which has been illustrated.

The pivot 4 has an extension which has an end face 6. The slot-shaped depression 7 extends across the pivot 4 and opens onto the end face 6 of the above-mentioned extension. An elastic element 2, illustrated as a helical spring, has an end portion 8 which is received in the slot 7 and thus affixes the spring 2 to the extension of the pivot 4. The spring 2 is convoluted around the extension of the pivot 4 and has another end portion 9 which abuts against a housing portion 3 of the mouthpiece 10.

Figure 2:
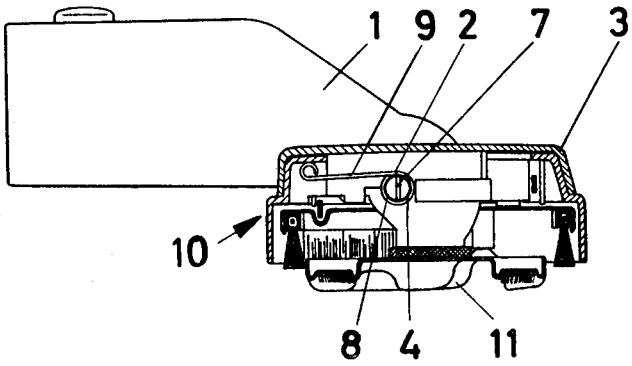
FIG. 2 is a sectional view taken on line II—II of FIG. 1.

As particularly well seen in FIG. 2, which is a sectional view which reveals the pivot 4 and the elastic element or spring 2, the pivot 4 defines a pivoting axis for relative pivoting of the suction nipple 1 and the mouthpiece 10. The one end portion 8 of the spring 2 is introduced into the slot-shaped depression 7 of the extension of the pivot 4 in direction from the end face 6. The extended end portion 9 of the spring leads from the pivot 4 toward and into abutment with the housing 3 of the mouthpiece 10. The spring 2 urges the mouthpiece 10 to a position which is illustrated in FIG. 2, that is, into the position in which the longitudinal axis of the suction nipple 1 and the bottom wall 11 of the mouthpiece 10 are parallel to one another. However, it will be appreciated that the basic concept of the present invention can also be used in an attachment in which the suction nipple 1 is configurated differently from what has been illustrated.

The position illustrated in FIG. 2 is that assumed when the attachment is being used for vacuum-cleaning a horizontal surface.

Figure 3:
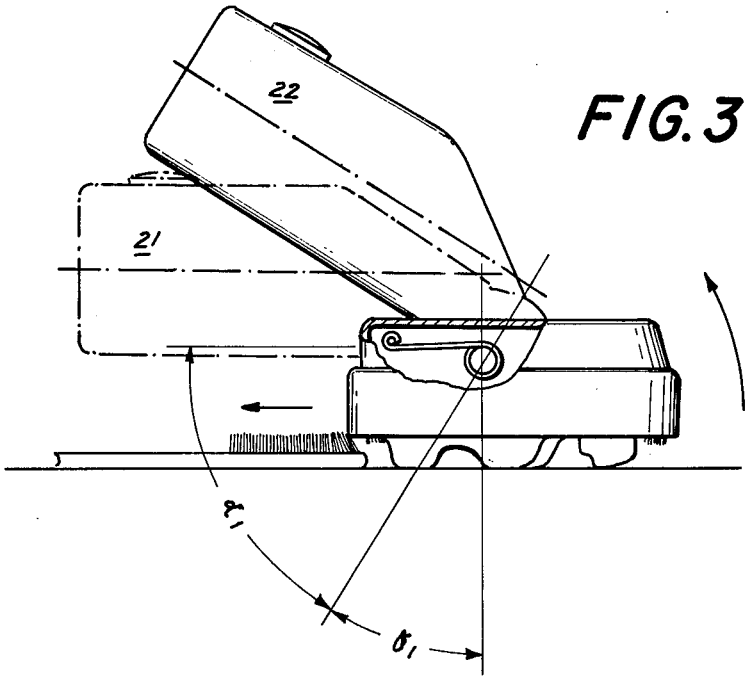
FIG. 3 is a schematic view of the attachment.

FIG. 3 shows in dash lines the suction nipple 1 in the position 21 corresponding to that shown in FIG. 2. In such a position the spring exerts no torsional force on the mouthpiece 10. This position corresponds to a situation where the spring end portion 9 (i.e., the spring arm which engages the housing 3) and the spring end portion 8 (i.e., which is fixed on the pivot 4) constitute together an angle $(\alpha_1+\gamma_1)$. Once the nipple 1 is tilted clockwise from the position 21 into a position 22 the spring (i.e., the end portion 9) exerts a torsional force onto the housing 3 of the mouthpiece 10. Should the nipple 1 tilt further away from the position 21 and relative to the mouthpiece 10, the torsional force will increase correspondingly so as to move the mouthpiece 10 relative to the nipple 1 into the position (FIG. 3) where the spring end portions 9 and 8 constitute together the angle $(\alpha_1+\gamma_1)$.

Figure 4:
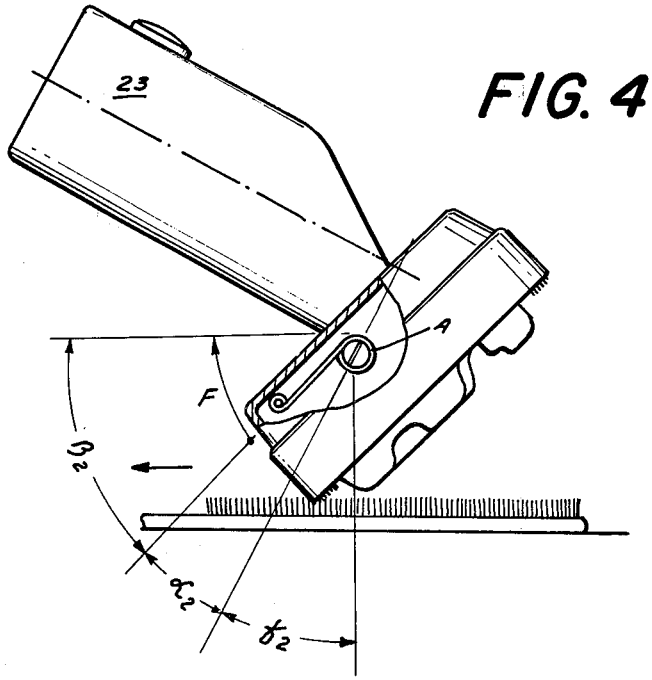
FIG. 4 is a schematic view of the attachment with a mouthpiece in a position different from that shown in FIG. 3.

When the mouthpiece 10 meets an obstruction, such as an edge of a carpet or the like, see for example FIGS. 3 and 4, the operator tilts the nipple 1 from its position 21 into the position 22 so as to increase the torsional force of the spring. Eventually this force urges the mouthpiece to pivot relative to an axis A and to the nipple 1 (see FIG. 4). In order to move the mouthpiece 10 back in its horizontal position relative to the surface to be cleaned the operator pivots the nipple 1 back and the mouth 10 follows its movement due to the biasing force of the spring. On the other hand, a mere lifting of the attachment from the surface being cleaned will permit the spring 2 to return the mouthpiece 10 into its illustrated position, upon which the vacuum-cleaning operation may be resumed by lowering the mouthpiece until the bottom wall 11 thereof contacts the surface to be vacuum-cleaned. If there were no biasing means (the case of the prior art devices) then upon meeting any obstruction the operator would have to raise the vacuum cleaner to overcome the obstruction and pivot the mouthpiece in the proper position before resuming the vacuum-cleaning operation. In the case of the present invention the operator only manipulates the handle (i.e., nipple 1) and the mouthpiece 10 (due to the biasing force of the spring) will follow movement of the suction nipple.

On the other hand, when the suction nipple 1 is pivoted about the pivot 4 in the clockwise direction as considered with respect to FIG. 2, into the leaning position of the vacuum-cleaner, that is, through an angle exceeding 90° but less than 180°, the spring 2 will be increasingly tensioned and, as a result of that, the mouthpiece 10 will be partially rotated in the clockwise direction as a result of which it will rest on the floor surface only at its right-hand edge as seen in FIG. 2, rather than on the entire bottom wall 11. Thus, slippage of the mouthpiece on the floor surface will be avoided.

Figure 5:
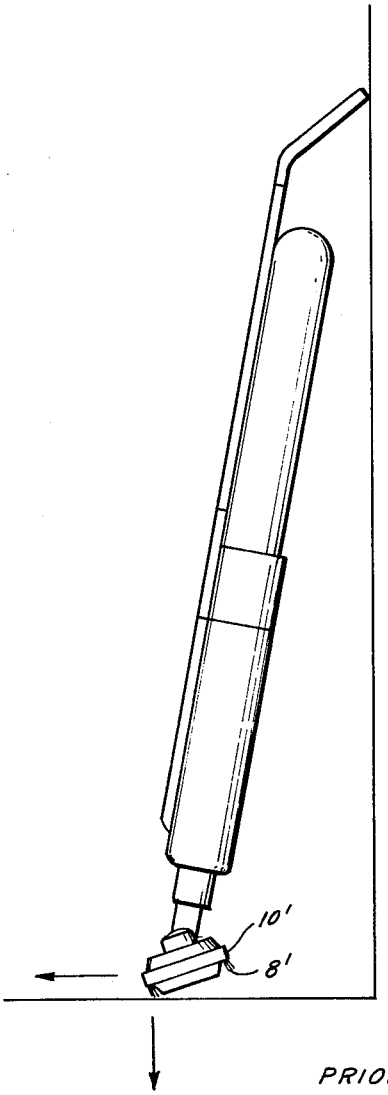
FIG. 5 is a schematic view of a prior art attachment in a leaning position.
Figure 6:
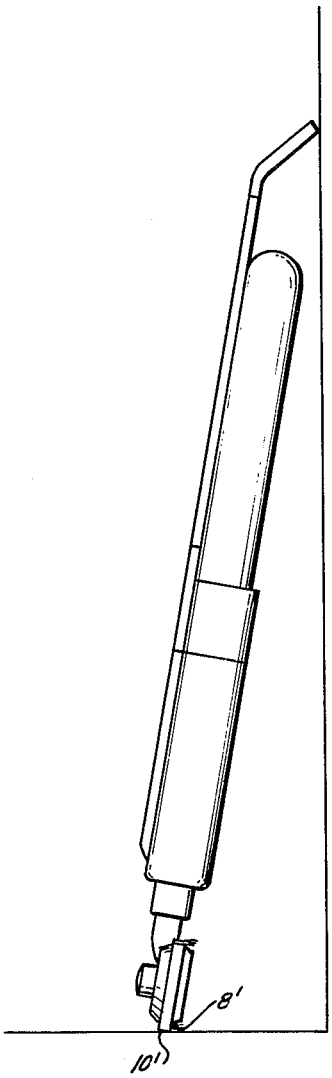
FIG. 6 PRIOR ART
FIG. 6 is a schematic view of the attachment in accordance with the present invention, in the leaning position.

FIGS. 5 and 6 show a vacuum-cleaner in such a leaning position. FIG. 5 shows a prior art vacuum-cleaner in such a position, whereas FIG. 6 illustrates the vacuum-cleaner in accordance with the present invention in the leaning position. Thus, the vacuum-cleaner is leaned against a wall or a similar substantially vertical support. The weight of the vacuum cleaner in such a leaning position subjects the mouthpiece to two force components, one of which is normal to the plane of the floor surface and the other of which is parallel thereto. On the other hand, the vacuum-cleaner abuts the wall against which it leans with a reaction force which is equal but opposite to the above-mentioned other force component. The action of this reaction force is most likely to result in sliding of the mouthpiece along the floor surface. As a result of sliding movement of the mouthpiece the vacuum-cleaner descends along the exposed surface of the wall with the possible negative consequences, which were discussed hereabove.

It is obvious that a conventional vacuum-cleaner cannot withstand the reaction force, especially when the latter exceeds the frictional force which holds the mouthpiece in the assumed position. In the case of the present invention, the spring 2 urges the mouthpiece 10 to rotate so that a face surface 10' rests on the floor surface (see FIG. 6).

It is obvious now that the mouth piece in this position besides the friction force is subject to two reaction forces, a first of which is directed normal from the floor surface and a second of which is parallel thereto and directed opposite to the reaction force from the wall so as to counteract the latter and together with the frictional force to prevent sliding of the mouthpiece.

It is to be mentioned in this context that if there were no biasing means the case of the prior art devices there would not be any additional force to counteract together with the frictional force the reaction force from the vertical wall.

Besides, it is clearly shown in FIG. 5 that the prior art vacuum-cleaner rests in the leaning position on the bristles 8'. Obviously due to the pressure of gravity of the vacuum-cleaner the bristles are subjected to deformation. The deformed bristles certainly decrease the efficiency of the vacuum-cleaning.

In the case of the present invention, see FIG. 6, the mouthpiece does not rest on the bristles 8', rather on the edge of the face surface 10' of the mouthpiece 10.

It will be understood that each of the elements described above, or two or more together, may also find a useful application in other types of constructions differing from the types described above.

While the invention has been illustrated and described as embodied in an attachment as used in connection with an upright vacuum-cleaner, it is not intended to be limited to the details shown, since various modifications and structural changes may be made without departing in any way from the spirit of the present invention. For instance, the same concept could be employed in an attachment to a cannister vacuum-cleaner where only the wand and the connecting hose is supported on the mouthpiece 10 and where only the wand rests against the wall or a similar surface during the period of non-use of the vacuum-cleaner.

Without further analysis, the foregoing will so fully reveal the gist of the present invention that others can, by applying current knowledge, readily adapt it for various applications without omitting features that, from the standpoint of prior art, fairly constitute essential characteristicis of the generic or specific aspects of this invention.

What is claimed as new and desired to be protected by Letters Patent is set forth in the appended claims:

1. A vacuum-cleaner attachment comprising, in combination, a mouthpiece member bounding a suction space; a suction nipple member; means for so mounting said members on one another that said suction nipple member communicates with said suction space and is movable relative to said mouthpiece member along a plane which is substantially normal to a surface being vacuum cleaned during the use of the attachment, said mounting means including at least one pivot which connects said members for relative pivoting along said plane, said pivot being rigid with one of said members and having an extension; and biasing means interposed between said members for urging one of said members toward a predetermined position relative to the other of said members, and to said surface in response to movement of said other member and including an elastic element which is affixed to said extension and has an engaging portion that acts on the other of said members to urge the same towards said predetermined position, said elastic element being a spring which is convoluted about said extension of said pivot, said spring having two end portions one of which is affixed to said extension and the other of which constitutes said engaging portion and abuts said other member.

2. A combination as defined in claim 1, wherein said pivot is a stub shaft rigid with said suction nipple member and extending therefrom normal to and away from said plane; and wherein said mounting means further includes an additional stub shaft similar to and aligned with said stub shaft and located across said plane from the latter.

3. A combination as defined in claim 1, wherein said extension has a channel which receives said one end portion of said spring to affix the latter to said pivot.

4. A combination as defined in claim 3, wherein said extension has an end face; and wherein said channel is configurated as a slot-shaped depression that extends across said extension and opens onto said end face.

* * * * *